US009744420B1

(12) United States Patent
Bergamini

(10) Patent No.: US 9,744,420 B1
(45) Date of Patent: Aug. 29, 2017

(54) SPORT COMBAT TRAINING MACHINE

(71) Applicant: Fabrizio Bergamini, Spoltore (IT)

(72) Inventor: Fabrizio Bergamini, Spoltore (IT)

( * ) Notice: Subject to any disclaimer, the term of this patent is extended or adjusted under 35 U.S.C. 154(b) by 0 days.

(21) Appl. No.: 15/193,240

(22) Filed: Jun. 27, 2016

(51) Int. Cl.
*A63B 24/00* (2006.01)
*A63B 69/00* (2006.01)

(52) U.S. Cl.
CPC ..... *A63B 69/004* (2013.01); *A63B 24/0087* (2013.01); *A63B 2220/12* (2013.01); *A63B 2220/20* (2013.01); *A63B 2220/30* (2013.01); *A63B 2220/40* (2013.01); *A63B 2220/53* (2013.01); *A63B 2220/56* (2013.01); *A63B 2220/72* (2013.01); *A63B 2220/80* (2013.01); *A63B 2220/803* (2013.01); *A63B 2220/805* (2013.01); *A63B 2225/50* (2013.01)

(58) Field of Classification Search
CPC ..... A63B 2220/80; A63B 2220/803; A63B 2220/12; A63B 2220/20; A63B 2220/30; A63B 2220/40; A63B 2220/805; A63B 2220/56; A63B 2220/53; A63B 2220/72; A63B 2225/50; A63B 24/00; A63B 24/0067; A63B 24/0087; A63B 69/004
See application file for complete search history.

(56) References Cited

U.S. PATENT DOCUMENTS 5,342,267 A 8/1994 Adams
5,679,103 A 10/1997 Pratchett
5,700,230 A 12/1997 Cardona
7,086,997 B1 8/2006 Fields et al.
7,416,517 B2 8/2008 Mitchell
7,857,729 B2 12/2010 Sullivan et al.
7,998,035 B2 8/2011 Chen
8,337,366 B2 12/2012 Jones et al.
8,602,944 B2 12/2013 Fleitz
2006/0025284 A1 2/2006 Livingstone et al.
2007/0167297 A1 7/2007 Stevenson
2014/0018212 A1 1/2014 Chen
2014/0128226 A1 5/2014 Chang
2014/0302969 A1 10/2014 Chen
2014/0378281 A1 12/2014 Mazi
2015/0011365 A1 1/2015 Nelson

FOREIGN PATENT DOCUMENTS

DE 19857988 A1 6/2000
WO 2013040416 A2 5/2014

*Primary Examiner* — Glenn Richman
(74) *Attorney, Agent, or Firm* — Albert Bordas, P.A.

(57) ABSTRACT

A sport combat training machine including a base assembly; a post; a shaft assembly having a spring adaptor; a mounting frame that mounts onto the post; a lower striking assembly having a first motor with a respective first adaptor having a first spring attached to a respective first lower striking arm; an intermediate striking assembly; an upper striking assembly including a second motor, with a second adaptor having a second spring attached to a respective first upper striking arm; and an electrical system having at least one computer configured with software to operate the first and second motors and a pedal for controlling the at least one computer. The intermediate striking assembly includes a body having a target area and at least one sensor. The sport combat training machine further includes a top plate assembly having at least one sensor.

20 Claims, 3 Drawing Sheets

SPORT COMBAT TRAINING MACHINE

BACKGROUND OF THE INVENTION

1. Field of the Invention

The present invention relates to exercise training machines, and more particularly, to combat training machines.

2. Description of the Related Art

Applicant believes that one of the closest references corresponds to U.S. Patent Application Publication No. 20150011365 A1, published on Jan. 8, 2015 to Jonathan Nelson for Body Hardening Machine. However, it differs from the present invention because Nelson teaches a machine for martial arts training that simulates sparring with a live partner and provides a safe tool for body hardening. The machine is a vertical alignment of three independently rotatable alpha bodies having arms and a weighted base, where each alpha body rotates when met by force from a user or may rotate to initiate strikes via servomotors. The machine facilitates martial arts offensive strikes and defensive moves, which safely promotes the formation of calcium deposits and scar tissue about key nerve areas to give the body a hardened feel.

Applicant believes that another reference corresponds to U.S. Patent Application Publication No. 20140378281 A1, published on Dec. 25, 2014 to Joseph Mazi for Robotic Sparring Partner. However, it differs from the present invention because Mazi teaches a robotic sparring device having an upright torso section operatively engaged with arms, legs, and a head. Both the arms and legs are formed of two sections and engaged to the torso at respective shoulder and hip positions. Computer controlled electric motors at points similar to human joints provide rotation of joined leg and arm sections in two planes. A computer controller is configured with software to elicit human like offensive and counter movements of the limbs of the sparring device in response to or an offensive movement toward a human sparring partner.

Applicant believes that another reference corresponds to U.S. Patent Application Publication No. 20140302969 A1, published on Oct. 9, 2014 to Tina Chen for Striking Trainer. However, it differs from the present invention because Chen teaches a striking trainer that includes a body and at least one first striking assembly. The first striking assembly further comprises an arm, a pivoting structure and a striking portion. The arm is assembled to the body. The pivoting structure has a first pivoting portion and a second pivoting portion. The arm has the first pivoting portion pivotally connected thereto and defines a first pivoting shaft thereon, so that the first pivoting portion is rotatable relative to the arm via the first pivoting shaft. The striking portion is pivotally connected to the second pivoting portion. A second pivoting shaft is defined on the second pivoting portion, so that the striking portion is rotatable relative to the second pivoting portion via the second pivoting shaft.

Applicant believes that another reference corresponds to U.S. Patent Application Publication No. 20140128226 A1, published on May 8, 2014 to Kuo Chi Chang for Freestanding Mixed Martial Arts Training Device. However, it differs from the present invention because Chang teaches a freestanding mixed martial arts training device that includes vertically connected first and second posts, a base stand connected to a lower end of the first post, a water containable pedestal assembly, and primary and secondary striking pads as well as kick training plates height-adjustably mounted to the first and second posts. The first and second posts can be supported in a freestanding state by the base stand with a plurality of suction cup assemblies mounted thereto, or by the pedestal assembly fitted around the base stand without using the suction cup assemblies. The first post is also connected to the base stand via a plurality of screws, so that striking forces applied to the first and second posts can be evenly distributed to the screws without causing a broken and leaking pedestal assembly due to stress concentration thereat.

Applicant believes that another reference corresponds to U.S. Patent Application Publication No. 20140018212 A1, published on Jan. 16, 2014 to Tina Chen for Boxing Training Device. However, it differs from the present invention because Chen teaches a boxing training device including a main body and at least one boxing assembly. The boxing assembly is mounted to an upper portion of a main body via a shell body. The shell body defines a receiving space, one end of a rod is disposed in the receiving space, and the rod is pivoted to the shell body via a pivoting portion. Two resilient members are disposed at two sides by the pivoting portion and resiliently engaged against between the rod and the shell body.

Applicant believes that another reference corresponds to U.S. Patent Application Publication No. 20070167297 A1, published on Jul. 19, 2007 to Leon William Stevenson for Exercise Training Apparatus. However, it differs from the present invention because Stevenson teaches a martial arts/boxing training apparatus. The apparatus includes a base plate for mounting the apparatus to a surface, a support member, and one or more padded balls that are adapted to move about the support member through connecting arms whose height is adjustable. The arms are rigid structures, which rotate in a horizontal plane about the support member whereby the length of each arm is adjustable. The support member may also include a flexible arm mounted thereto, which is not only capable of rotational movement in a single plane, but is also capable of tiltable and pivotable motion relative to the support member which adds a further dimension to the training apparatus.

Applicant believes that another reference corresponds to U.S. Patent Application Publication No. 20060025284 A1, published on Feb. 2, 2006 to John F. Livingstone, et al. for Karate Master. However, it differs from the present invention because Livingstone teaches a portable exercise device consisting of a base, which holds a pole in a vertical position that one or more arms are attached to. Each arm can freely rotate around the pole. At the end of each arm is a pad that can be hit by the user to propel the arms around the pole allowing the user to hit the pad again without changing their position. The arms that are mounted on the pole can be adjusted up and down the pole by using the collar device.

Applicant believes that another reference corresponds to U.S. Pat. No. 8,602,944 B2 issued to Zachary Fleitz on Dec. 10, 2013 for Wing Chun Dummy Controller. However, it differs from the present invention because Fleitz teaches a Wing Chun dummy including a plurality of transducers associated with the dummy, wherein a physical impact to the dummy activates at least one of the transducers to generate an output signal. In another example a device includes a body; a plurality of appendages; and a plurality of transducers associated with the appendages wherein the plurality of transducers are located such that a physical impact to any of the appendages activates at least one transducer to generate an output signal further wherein, different output signals are generated based on the direction of the impact to each appendage.

Applicant believes that another reference corresponds to U.S. Pat. No. 8,337,366 B2 issued to Terry G. Jones, et al. on Dec. 25, 2012 for Interactive System and Method for Boxing and Martial Arts. However, it differs from the present invention because Jones teaches a boxing or martial arts training and exercise device that includes punching pads locationally displaced on a frame. Respective pads may be positioned in support on the frame for punching and kicking. Each pad can communicatively connect to one or more impact sensor. Each impact sensor can communicatively connect to a control unit. The control unit may be communicatively connected to a display. The impact sensor detects strikes to the pad. The impact sensor includes an accelerometer and a signal processor. The control unit includes an aggregator for receiving and logging strike metrics. The control unit directs sequences in the display according to a routine, and delivers indicators of strike metrics. The control unit includes a user interface for selection among sequences, as well as for selection of various menu items. A video of a human instructor or an animated avatar is viewable in a display.

Applicant believes that another reference corresponds to U.S. Pat. No. 7,998,035 B2 issued to Yi-Lin Chen on Aug. 16, 2011 for Kung Fu Training Device. However, it differs from the present invention because Chen teaches a kung fu training device that includes a base portion, a body portion and two arms. The body portion is disposed on the base portion. The body portion includes a vertical rod, a lateral rod and a wrapping element. The lateral rod is firmly disposed on the vertical rod. The wrapping element covers the rods. The arms are disposed on the body portion. The arms are height-adjustable and relative-distance-adjustable.

Applicant believes that another reference corresponds to U.S. Pat. No. 7,857,729 B2 issued to Christopher Sullivan, et al. on Dec. 28, 2010 for Automated Striking and Blocking Trainer with Quantitative Feedback. However, it differs from the present invention because Sullivan teaches an automated striking and blocking trainer. In some embodiments, the trainer includes a frame; a striking body joined with the frame, the punching bag including one or more strike zone assemblies, the strike zone assemblies each having a light indicator and a striking force sensor; an arm assembly joined with the frame, the arm assembly including one or more arms, each of the one or more arms including a voltage differential sensor and a motion indicator in the form of an electrical motor, wherein the voltage differential between the power being used by the electrical motor when the one or more arms are not struck and when the one or more arms are struck is used to determine a torque of the one or more arms and an input force of a blocking strike; and a head assembly including a processor unit and a display.

Applicant believes that another reference corresponds to U.S. Pat. No. 7,416,517 B2 issued to Donald W. Mitchell on Aug. 26, 2008 for Interactive Martial Arts Training Apparatus. However, it differs from the present invention because Mitchell teaches a martial arts training device, a kit for assembling the device, and a method of using the device. The device includes a vertical elongate shaft supported by a rotary bearing, the rotary bearing supported by a base such that the shaft can rotate freely 360 degrees in either direction, the device including at least four arms, each arm extending out from the shaft at about a right angles thereto, the arms being located in spaced apart relationship both with respect to the length of the shaft and with respect to orientation around the shaft in a plane normal to the shaft, wherein each arm after a first arm has a predecessor arm along the shaft, and each arm after the first arm is rotated at least 60 degree with respect to its predecessor arm.

Applicant believes that another reference corresponds to U.S. Pat. No. 7,086,997 B1 issued to Sara B. Fields, et al. on Aug. 8, 2006 for Martial Arts Practice Device. However, it differs from the present invention because Fields teaches a martial arts practice device that is freestanding and can be used by one or more practitioners. The device has a base, which can be filled with liquid for weighting, a stem extending upwardly from the base and a plurality of rails attached to the stem. A plurality of target adapter assemblies are slidably mounted on the rails. A target is attached to each target adapter assembly by a target attachment assembly. The target attachment assemblies include an elastomeric pivot so that the targets can pivot in any direction with respect to the target adapter assemblies.

Applicant believes that another reference corresponds to U.S. Pat. No. 5,700,230 A issued to Alfred M. Cardona on Dec. 23, 1997 for Martial Arts Training Device. However, it differs from the present invention because Cardona teaches a martial arts training device, which comprises a movable mannequin having a human appearance. A structure is for supporting the mannequin in a generally upright position from a floor. A facility within the mannequin is for showing a reaction movement of a portion of the mannequin, when another portion of the mannequin receives a blow thereto from a martial artist.

Applicant believes that another reference corresponds to U.S. Pat. No. 5,679,103 A issued to Vincent Pratchett on Oct. 21, 1997 for Exercising Device. However, it differs from the present invention because Pratchett teaches an exercising device to be used in hand-to-hand combat training or to enhance hand, eye and foot reflexes, and coordination. The device comprises a central longitudinal body, which is generally vertically oriented and has at least one elongate cross member, having two opposing ends, pivotally mounted on the central body. The said opposing ends extend radially outward in opposite directions from said central body allowing the cross member to rotate about the longitudinal axis of the central body. When one of said ends of the cross member is struck by the hand or foot of an operator, the end moves rotationally away from said operator while the opposing end moves rotationally toward the operator thereby requiring the operator to react defensively to avoid being hit by the opposing end.

Applicant believes that another reference corresponds to U.S. Pat. No. 5,342,267 A issued to Ronald L. Adams on Aug. 30, 1994 for Striking Device. However, it differs from the present invention because Adams teaches a striking device including a main post having two main longitudinal slots. An insert post has an outside diameter that is less than the inside diameter of the main post. A striking surface is attached to an arm, which in turn is attached to an arm housing. The arm housing has a first housing end and a second housing end. The arm housing is placed around the main post and the second housing end rests upon a support axle passing through the insert post. The first housing end includes a cam surface having two peaks located on opposite sides thereof and two valleys located on opposite sides thereof with each of the two valleys disposed between each of the two peaks. A cam follower is included which is retained in contact against the cam surface by a pair of springs. During rotation of the arm housing the cam follower cooperates with the cam surface of the arm housing to provide a first striking position and a second striking position that are each located one hundred and eighty degrees of rotation apart with respect to each other. As the arm housing rotates, the cam surface extends the cam follower, which is turn extends the pair of springs in proportion to the contour of the cam surface. If sufficient force is imparted to the striking surface, the arm housing is urged away from the first striking position, and indexes into the second striking position.

Applicant believes that another reference corresponds to Patent No. DE 19857988 A1 issued to Walter Bosbach on Jun. 29, 2000 for Holding for a Training Device. However, it differs from the present invention because Bosbach teaches a holding for a training device for a sportier self conditioning comprising a main rod arranged vertically in a space, and one essentially transverse to a longitudinal axis trending support arm. Taking the exercise equipment at a first end and a second end, it can be rotated with the main bar that is connectable to develop such. A fixture with a rotation-limiting device limits the rotation of the support arm above a certain point. A stopper releasably fixes the support arm to provide a rotation limiter device.

Applicant believes that another reference corresponds to WIPO Publication No. 2013040416 A2 issued to Terry Jones, et al. on May 8, 2014 for Interactive System and Method for Boxing and Martial Arts. However, it differs from the present invention because Jones et al. teaches a boxing or martial arts training and exercise device that includes punching pads locationally displaced on a frame. Respective pads may be positioned in support on the frame for punching and kicking. Each pad can communicatively connect to one or more impact sensor. Each impact sensor can communicatively connect to a control unit. The control unit may be communicatively connected to a display. The impact sensor detects strikes to the pad. The impact sensor includes an accelerometer and a signal processor. The control unit includes an aggregator for receiving and logging strike metrics. The control unit directs sequences in the display according to a routine, and delivers indicators of strike metrics. The control unit includes a user interface for selection among sequences, as well as for selection of various menu items. A video of a human instructor or an animated avatar is viewable in a display.

Other patents describing the closest subject matter provide for a number of more or less complicated features that fail to solve the problem in an efficient and economical way. None of these patents suggest the novel features of the present invention.

SUMMARY OF THE INVENTION

The present invention is a sport combat training machine, comprising a base assembly with a base. A post comprises first and second ends, and a first at least one through hole. A shaft assembly comprises third and fourth ends. A spring adaptor is mounted onto the third end. A mounting frame mounts onto the post. A lower striking assembly comprises a first motor with a respective first adaptor having a first spring attached to a respective first lower striking arm. Further comprising an intermediate striking assembly. Further comprising an upper striking assembly with a second motor securing a support plate, and a second adaptor having a second spring attached to a respective first upper striking arm. An electrical system comprises at least one computer configured with software to operate the first and second motors.

The base has a mounting hole to receive the first end.

The spring adaptor comprises top and bottom plates, and positioned between the top and bottom plates is a third spring. The top plate is mounted onto the third end.

The mounting frame comprises a bracket having at least one motor base. The first motor mounts upon its respective at least one motor base.

The intermediate striking assembly comprises a body having fifth and sixth ends. The body further comprises a target area and at least one sensor. The at least one sensor is an acoustic, sound, vibration, motion, position, angle, displacement, distance, speed, acceleration, optical, light, imaging, photon, pressure, force, density, level, thermal, heat, temperature, proximity, and/or presence sensor.

The upper striking assembly further comprises a cover. The cover comprises at least one hole. A respective second adaptor protrudes through the at least one hole.

The sport combat training machine further comprises a top plate assembly. The top plate assembly comprises at least one sensor. The at least one sensor is an acoustic, sound, vibration, motion, position, angle, displacement, distance, speed, acceleration, optical, light, imaging, photon, pressure, force, density, level, thermal, heat, temperature, proximity, and/or presence sensor.

The upper striking assembly further comprises a support ring.

The spring adaptor comprises an extension adaptor having a second at least one through hole. The second end receives the extension adaptor.

The electrical system further comprises a pedal for controlling the at least one computer.

It is therefore one of the main objects of the present invention to provide a sport combat training machine for physical training activities, in particular for combat sports.

It is another object of this invention to provide a sport combat training machine that is versatile.

It is another object of this invention to provide a sport combat training machine comprising integrated software to randomly operate its striking assemblies.

It is another object of this invention to provide a sport combat training machine comprising integrated software to randomly operate its striking assemblies according to a skill and training level of a user.

It is another object of this invention to provide an adjustable sport combat training machine.

It is another object of this invention to provide a sport combat training machine that is volumetrically efficient for carrying, transporting, and storage.

It is another object of this invention to provide a sport combat training machine that can be readily assembled and disassembled without the need of any special tools.

It is another object of this invention to provide a sport combat training machine, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
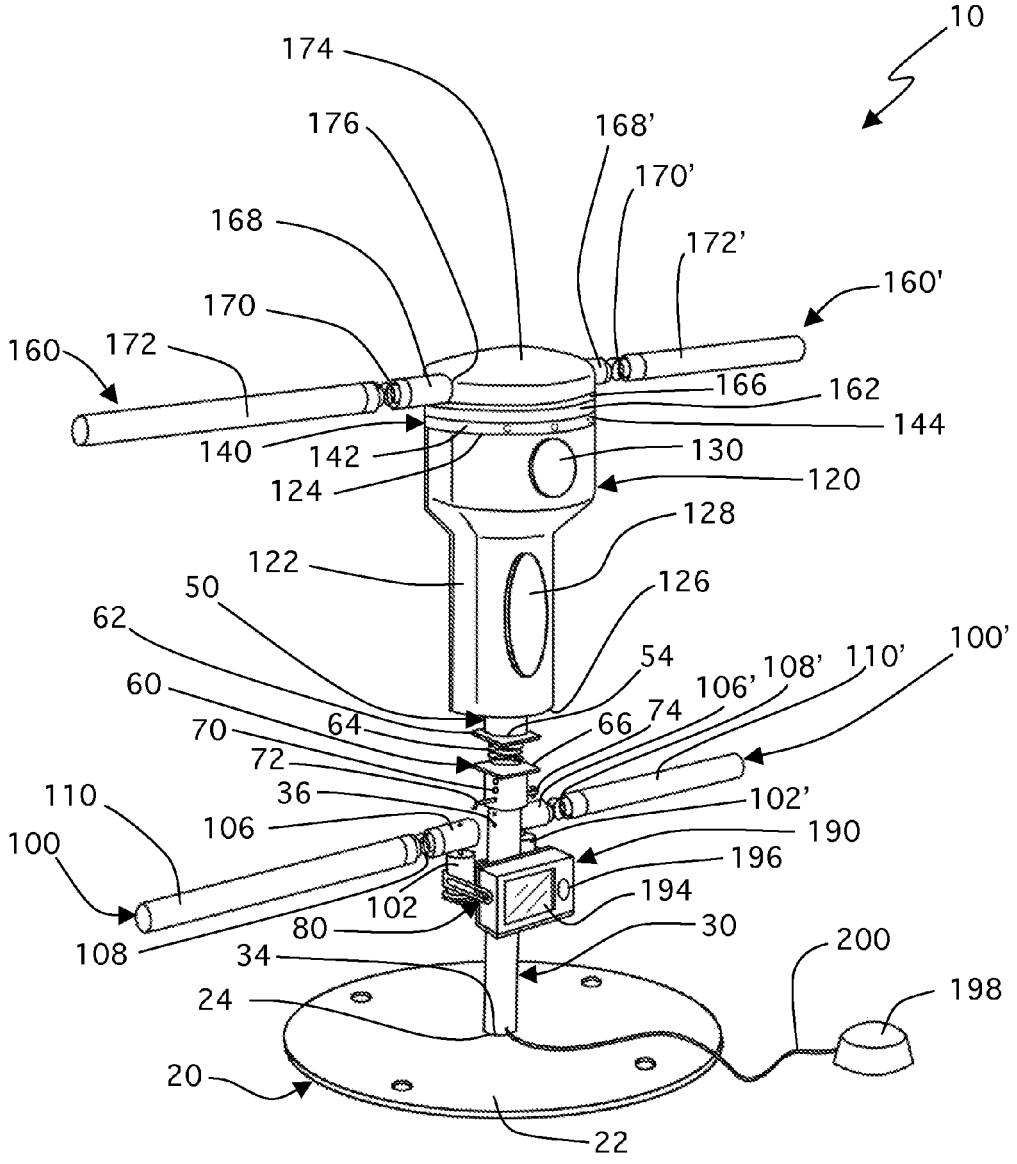
FIG. 1 represents a front isometric view of a sport combat training machine.

Referring now to the drawings, the present invention is a sport combat training machine, and is generally referred to with numeral 10.

As seen in FIG. 1, sport combat training machine 10 basically includes base assembly 20, post 30, shaft assembly 50, spring adaptor 60, mounting frame 80, lower striking assemblies 100 and 100', intermediate striking assembly 120, top plate assembly 140, upper striking assemblies 160 and 160', and electrical system 190.

Figure 2:
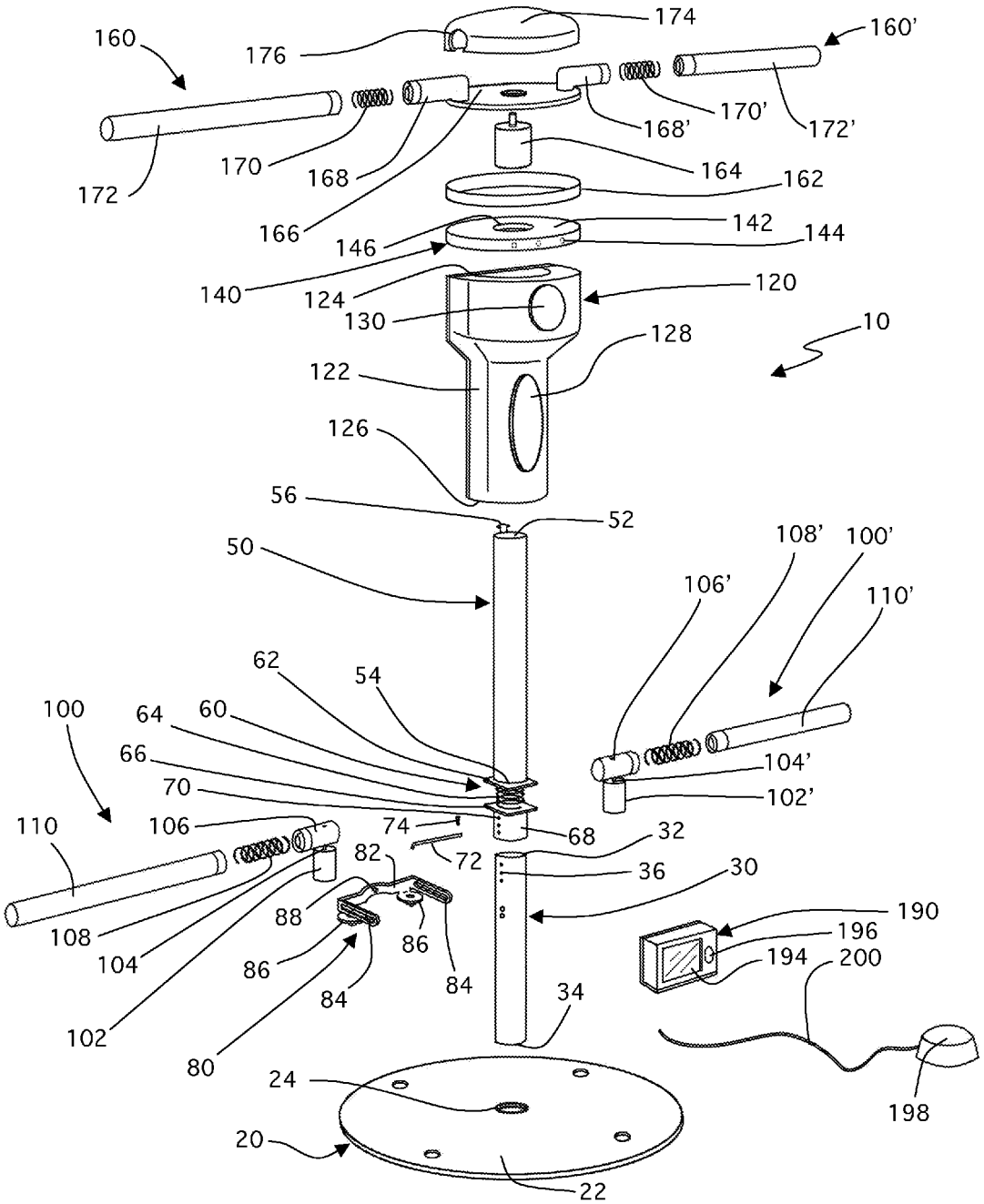
FIG. 2 is an exploded top view of the sport combat training machine.
Figure 3:
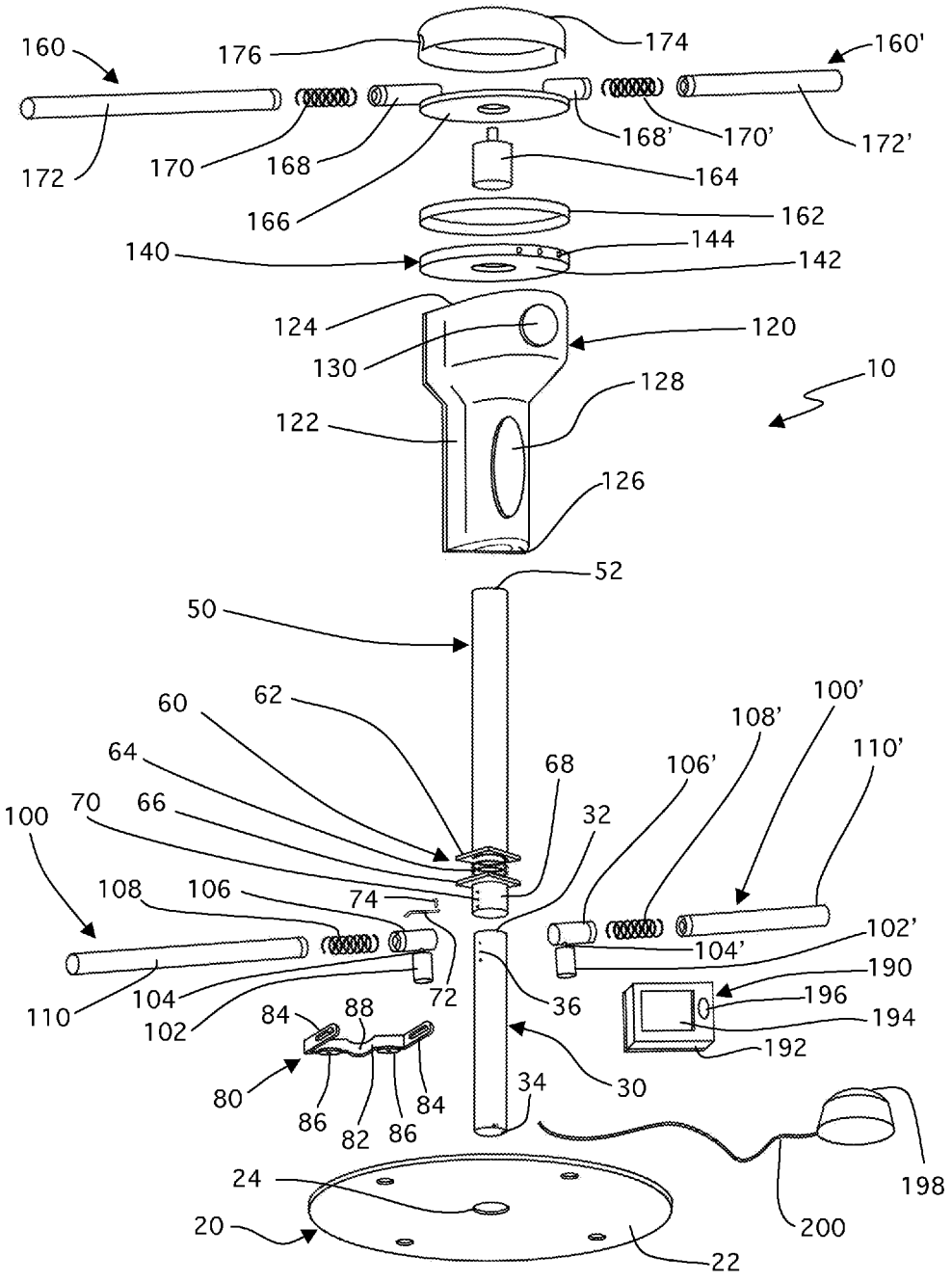
FIG. 3 is an exploded bottom view of the sport combat training machine.

As seen in FIGS. 2 and 3, base assembly 20 comprises base 22 with mounting hole 24 to receive end 34 of post 30.

Post 30 has ends 32 and 34. Post 30 comprises through holes 36 vertically aligned at a first predetermined distance from each other, an upper one being disposed adjacent to end 32. End 34 is secured within mounting hole 24 of base 22.

Shaft assembly 50 is connected to post 30 with spring adaptor 60. Shaft assembly 50 has ends 52 and 54. Extending upwardly from end 52 is alignment tab 56.

Spring adaptor 60 is mounted onto end 54 of shaft assembly 50. Spring adaptor 60 comprises top and bottom plates 62 and 66 respectively. Positioned between top and bottom plates 62 and 66 is spring 64. Extension adaptor 68 extends downwardly from bottom plate 66. Extension adaptor 68 has through holes 70, which are vertically aligned and at a second predetermined distance from each other. The second predetermined distance is the same as the first predetermined distance. End 32 receives extension adaptor 68. When assembled, end 32 and a portion thereof, are inserted into extension adaptor 68. When through holes 70 are aligned with through holes 36, the selected position is secured with pin 72 and set screw 74. End 54 of shaft assembly 50 is secured to top plate 62 of spring adaptor 60.

Mounting frame 80 is removably mounted to post 30. In a preferred embodiment, mounting frame 80 comprises bracket 82 having arm members 84 and motor bases 86. Bracket 82 has through hole 88. Motors 102 and 102' mount upon their respective motor bases 86.

Lower striking assembly 100 comprises motor 102 with respective adaptor 106. Lower striking assembly 100 further comprises pin 104, and spring 108 attached to respective lower striking arm 110.

Similarly, lower striking assembly 100' comprises motor 102' with respective adaptor 106'. Lower striking assembly 100' further comprises pin 104' and spring 108' attached to respective lower striking arm 110'.

Motors 102 and 102' are secured upon motor bases 86. Adaptor 106 is secured onto pin 104. Spring 108 and striking arm 110 rotate with adaptor 106.

Similarly, adaptor 106' is secured upon pin 104'. Spring 108' and striking arm 110' rotate with adaptor 106'.

Intermediate striking assembly 120 is mounted to shaft assembly 50. Intermediate striking assembly 120 comprises body 122 having ends 124 and 126. Body 122 further comprises target area 128 with at least one sensor 130. Sensors 130 are acoustic, sound, vibration, motion, position, angle, displacement, distance, speed, acceleration, optical, light, imaging, photon, pressure, force, density, level, thermal, heat, temperature, proximity, and/or presence sensors.

Top plate assembly 140 comprises plate 142 with hole 146 and sensors 144. Top plate assembly 140 mounts upon end 124 of intermediate striking assembly 120. Sensors 144 are acoustic, sound, vibration, motion, position, angle, displacement, distance, speed, acceleration, optical, light, imaging, photon, pressure, force, density, level, thermal, heat, temperature, proximity, and/or presence sensors.

Upper striking assembly 160 comprises support ring 162, motor 164, and support plate 166. When assembled, motor 164 is positioned within hole 146, while support ring 162 receives support plate 166. Upper striking assembly 160' comprises upper adaptor 168' having spring 170' attached to upper striking arm 172'. Upper adaptors 168 and 168' are secured to support plate 166 at an opposite position with respect to each other. In addition, motor 164 is secured to support plate 166. Upper striking arms 172 and 172' are connected to upper adaptors 168 and 168' with springs 170 and 170' respectively. Upper striking assembly 160 further comprises cover 174 with holes 176, also at an opposite position with respect to each other. Cover 174 mounts upon support plate 166 while upper adaptors 168 and 168' protrude through holes 176.

Electrical system 190 controls and operates sport combat training machine 10. Additionally, electrical system 190 comprises software programs to provide random movements to lower striking assemblies 100 and 100', and upper striking assemblies 160 and 160'. Electrical system 190 comprises computer 192 configured with software to operate motors 102, 102', and 164. Computer 192 comprises at least one display 194, and switch 196. Electrical system 190 further comprises pedal 198 for controlling computer 192. Pedal 198 has cable 200. Pedal 198 may be used for security purposes, as an example, for the immediate stop of sport combat training machine 10. Display 194 of computer 192 comprises a touch-sensitive interface, through which it provides information and data to the user. Additionally, electrical system 190 operates with different signal lights and/or sounds to communicate predetermined alerts to the user. A sound system is implemented with speakers, electronic components for amplification, electronic components for the manipulation of an audio signal, through which computer 192 generates training instructions, alerts, status updates, warnings, and/or user's selected music. Switch 196 may be implemented as a keypad and/or rotary switches, through which the user may control the functions of sport combat training machine 10.

Electrical system 190, and more specifically, the software of computer 192 may be configured with a biometric system that analyzes the user's physical conditions, processes interacting with the user and modifies programs depending thereof. Electrical system 190 may also comprise USB, WIFI, and/or BLUETOOTH to monitor, update and diagnostics via a computer, tablet, smartphone or any suitable device, by the user or trainer.

Computer 192 is a programmable electronic device designed to accept data, perform prescribed mathematical and logical operations at high speed, and display the results of these operations. Mainframes, desktop and laptop computers, tablets, and smartphones are some of the different types of computers.

More specifically, computer 192, and a computer in general, is a computing device, and as used herein relates to any computing device including smart phones, tablet computers, mobile computing devices, stationary computers, and/or combinations thereof without limit. Computer, including its hardware and software, is generally understood to mean any device with a microprocessor configured to store a file on a non-transitory computer readable medium and subsequently access the Internet and transmit said stored file and/or signals.

Computer 192 comprises display 194. In a preferred embodiment, display 194 is a touchscreen defined as an electronic visual display that a user can control through simple or multi-touch gestures by touching display 194 with a special stylus/pen and-or one or more fingers. Some touchscreens use an ordinary or specially coated gloves to work while others use a special stylus/pen only. The user can use the touchscreen to react to what is displayed and to control how it is displayed. The touchscreen enables the user to interact directly with what is displayed, rather than using a mouse, touchpad, or any other intermediate device (other than a stylus, which is optional for some modern touchscreens). Touchscreens are common in devices such as game consoles, all-in one computers, tablet computers, and smartphones. They can also be attached to computers or, as terminals, to networks. They also play a prominent role in the design of digital appliances such as personal digital assistants (PDAs), satellite navigation devices, mobile phones, and video games and some books such as electronic books.

In a preferred embodiment, sport combat training machine 10 is fixed to a ground, and is used for training of boxing, fighting, and martial arts while it is able to simulate an attack by an opponent through random movements of lower striking assembly 100 and 100', and upper striking assembly 160 and 160'.

Lower striking arms 110 and 110' and upper striking arms 172 and 172' may be covered with protective materials that absorb strikes to reduce chances of injury and/or accidents. Additionally, lower striking arms 110 and 110' and upper striking arms 172 and 172' may have different lengths depending on a height at which they are located and/or different configurations of sport combat training machine 10.

Sensors 130 and 144 detect whether a user is in correct positions with respect to sport combat training machine 10. Only when the user is at the correct position, sport combat training machine 10 starts a training session.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sport combat training machine, comprising:

A) a base assembly comprising a base;

B) a post comprising first and second ends, and a first at least one through hole;

C) a shaft assembly comprising third and fourth ends, and a spring adaptor mounted onto said third end;

D) a mounting frame that mounts onto said post;

E) a lower striking assembly comprising a first motor with a respective first adaptor having a first spring attached to a respective first lower striking arm;

F) an intermediate striking assembly;

G) an upper striking assembly comprising a second motor securing a support plate, with a second adaptor having a second spring attached to a respective first upper striking arm; and H) an electrical system comprising at least one computer configured with software to operate said first and second motors.

2. The sport combat training machine set forth in claim 1, further characterized in that said base has a mounting hole to receive said first end.

3. The sport combat training machine set forth in claim 1, further characterized in that said spring adaptor comprises top and bottom plates, and positioned between said top and bottom plates is a third spring.

4. The sport combat training machine set forth in claim 3, further characterized in that said top plate is mounted onto said third end.

5. The sport combat training machine set forth in claim 1, further characterized in that said mounting frame comprises a bracket having at least one motor base.

6. The sport combat training machine set forth in claim 5, further characterized in that said first motor mounts upon its respective said at least one motor base.

7. The sport combat training machine set forth in claim 1, further characterized in that said intermediate striking assembly comprises a body having fifth and sixth ends.

8. The sport combat training machine set forth in claim 7, further characterized in that said body further comprises a target area.

9. The sport combat training machine set forth in claim 8, further characterized in that said body further comprises at least one sensor.

10. The sport combat training machine set forth in claim 9, further characterized in that said at least one sensor is an acoustic, sound, vibration, motion, position, angle, displacement, distance, speed, acceleration, optical, light, imaging, photon, pressure, force, density, level, thermal, heat, temperature, proximity, and/or presence sensor.

11. The sport combat training machine set forth in claim 1, further characterized in that said upper striking assembly further comprises a cover.

12. The sport combat training machine set forth in claim 11, further characterized in that said cover comprises at least one hole.

13. The sport combat training machine set forth in claim 12, further characterized in that a respective said second adaptor protrudes through said at least one hole.

14. The sport combat training machine set forth in claim 1, further comprising:

I) a top plate assembly.

15. The sport combat training machine set forth in claim 14, further characterized in that said top plate assembly comprises at least one sensor.

16. The sport combat training machine set forth in claim 15, further characterized in that said at least one sensor is an acoustic, sound, vibration, motion, position, angle, displacement, distance, speed, acceleration, optical, light, imaging, photon, pressure, force, density, level, thermal, heat, temperature, proximity, and/or presence sensor.

17. The sport combat training machine set forth in claim 1, further characterized in that said upper striking assembly further comprises a support ring.

18. The sport combat training machine set forth in claim 1, further characterized in that said spring adaptor comprises an extension adaptor having a second at least one through hole.

19. The sport combat training machine set forth in claim 18, further characterized in that said second end receives said extension adaptor.

20. The sport combat training machine set forth in claim 1, further characterized in that said electrical system further comprises a pedal for controlling said at least one computer.

* * * * *